US007097460B2

(12) United States Patent
Clark et al.

(10) Patent No.: US 7,097,460 B2
(45) Date of Patent: Aug. 29, 2006

(54) COAXIAL CONNECTOR

(75) Inventors: William E. Clark, West Melbourne, FL (US); Joey D. Sartin, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 11/048,214

(22) Filed: Feb. 1, 2005

(65) Prior Publication Data

US 2006/0172561 A1 Aug. 3, 2006

(51) Int. Cl.
*H01R 12/00* (2006.01)

(52) U.S. Cl. ..... 439/63; 439/66

(58) Field of Classification Search ..... 439/63, 439/578–582, 700, 66

See application file for complete search history.

(56) References Cited

U.S. PATENT DOCUMENTS 4,925,403 A 5/1990 Zorzy
6,699,054 B1 3/2004 Critelli
6,758,680 B1 7/2004 Duquerroy et al.
6,921,299 B1 * 7/2005 McMaster ..... 439/700

* cited by examiner

*Primary Examiner*—Khiem Nguyen
(74) *Attorney, Agent, or Firm*—Sacco & Associates, PA; Robert J. Sacco

(57) ABSTRACT

A coaxial connector (100) which includes first and second contact pins (104, 106), an outer contact member (102) and an inner alignment member (320). The inner alignment member can be electrically conductive and coaxially positioned within the outer contact member. The inner alignment member can include at least one substantially tubular portion (322) with opposing first and second end portions (324, 326). Each of the contact pins can include a first end portion (336, 338) contained within the substantially tubular portion, and a second end portion (344, 346) which extends beyond a respective end portion (324,326) of the inner alignment member. A spring (356) can be disposed between the first end portions of the respective contact pins to resiliently bias the contact pins in opposing directions.

19 Claims, 3 Drawing Sheets

COAXIAL CONNECTOR

BACKGROUND OF THE INVENTION

1. Statement of the Technical Field

The inventive arrangements relate to coaxial connectors and, more particularly, to coaxial connectors for interconnecting printed circuit boards.

2. Description of the Related Art

When assembling electrical systems it is often necessary to connect two or more printed circuit boards (PCBs) to transmit high frequency signals from one PCB to another. Coaxial connectors are conventionally used to establish a reliable signal connection between the PCBs. For example, female-to-female coaxial connectors, such as SMP connectors as described in MIL-STD-348, are sometimes used. Such connectors are not ideal. In particular, female-to-female connectors require male features, such as male shrouds and male pins, to be incorporated into the PCBs. Male pins are expensive to incorporate into a PCB and are very fragile. Moreover, male shrouds installed on PCBs tend to be quite large, thereby impeding circuit miniaturization.

Surface mount coaxial connectors also have been developed to provide a conduction path for high frequency signals. One such connector is disclosed in U.S. Pat. No. 6,699,054 to Critelli. Critelli describes a coaxial connector which includes inner and outer contact assemblies. The outer contact assembly includes a base securely mounted to a PCB and a floating outer contact that can move both axially and radially relative to the base. The inner contact assembly includes a plunger connected to a signal carrying circuit element on the circuit board in a manner that permits transverse float. Another connector is disclosed by U.S. Pat. No. 6,758,680 to Duquerroy et al. Duguerroy describes a coaxial connector having a dielectric case securely fixed to a PCB. The connector also includes an inner conductor and an outer conductor, each of which are resiliently biased between a mated position and an unmated position.

An electrical system for interconnecting two PCBs using a coaxial connector in blind mate fashion is disclosed in U.S. Pat. No. 4,925,403 to Zorzy. Zorzy describes a coaxial connector having female elements on either end of a center conductor that is coaxially positioned within an outer conductive shell. A dielectric is disposed between the outer conductive shell and the female elements/center conductor. The connector includes two end portions, each of which are configured for interfacing with a male connector attached to a PCB or other such electronic device.

In both Critelli and Duguerroy, the coaxial connectors are surface mount structures securely fixed to the PCBs, as noted. In Zorzy the coaxial connector is disposed between a pair of male connectors. Each of the aforementioned structures is expensive to implement. Moreover, these connectors protrude significantly from the PCBs, and thus can be easily damaged. Accordingly, a durable, compact and inexpensive coaxial connector is needed for connecting PCBs to one another.

SUMMARY OF THE INVENTION

The present invention relates to a coaxial connector which can be used to provide a signal connection between two printed circuit boards (PCBs). The coaxial connector can include first and second contact pins, an outer contact member and an inner alignment member. The inner alignment member can be electrically conductive and coaxially positioned within the outer contact member. The inner alignment member can include at least one substantially tubular portion with opposing first and second end portions. Each of the contact pins can include a first end portion contained within the substantially tubular portion, and a second end portion which extends beyond a respective end portion of the inner alignment member. A spring can be disposed between the first end portions of the respective contact pins to resiliently bias the contact pins in opposing directions.

The coaxial connector can further include at least one dielectric member disposed between the outer contact member and at least one of the first and second end portions of the inner alignment member. The dielectric member can include a protruded portion extending beyond at least one of the end portions of the inner alignment member. The protruded portion can define a guide channel for a respective one of the first and second contact pins.

The present invention also relates to an electrical system that includes a first PCB, a second PCB, and the fore mentioned coaxial connector. Each of the PCBs can include a connector receptacle such that each end of the coaxial connector is positioned within a respective one of the connector receptacles. Each of the PCBs also can include a contact pad that contacts a respective pin of the coaxial connector. For instance, the first contact pin can contact the contact pad of the first PCB and the second contact pin can contact the contact pad of the second PCB.

DETAILED DESCRIPTION OF THE PREFERRED EMBODIMENTS

The present invention relates to a low cost coaxial connector which can be interposed between a first printed circuit board (PCB) and a second PCB to provide a signal connection between the first and second PCBs. The coaxial connector includes resiliently biased and self-adjusting contact pins at opposing ends of the connector for maintaining electrical continuity between contact pads of the respective PCBs. Further, the coaxial connector includes an outer contact member having opposing end portions which engage connector receptacles on the respective PCBs. The outer contact member can provide a high frequency return path—or ground—for RF signals communicated between the first and second PCBs via the contact pins.

Figure 1:
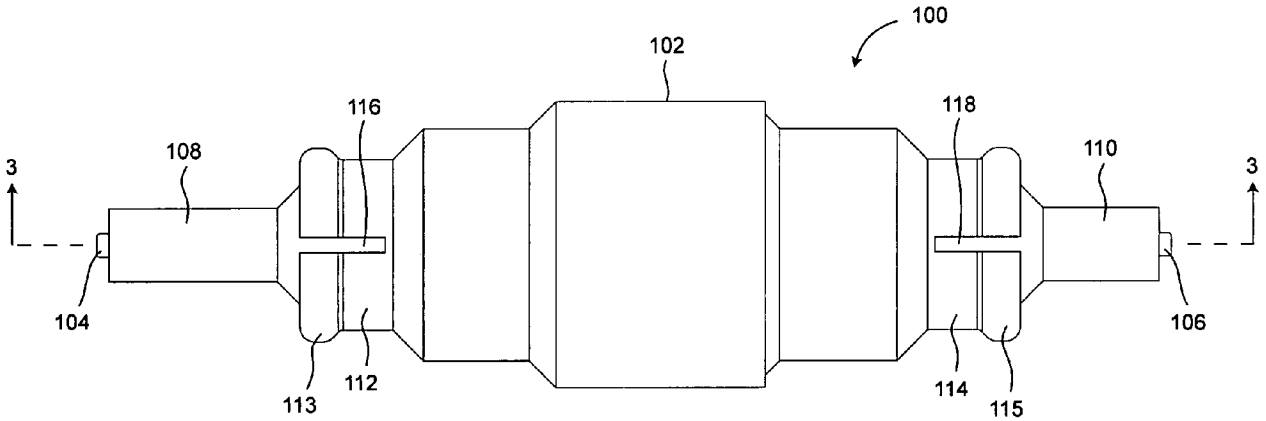
FIG. 1 is side view of coaxial connector which is useful for understanding the present invention.

Referring to FIG. 1, a side view of a coaxial connector 100 (hereinafter "connector") is shown. The connector 100 can comprise an outer contact member 102, a first contact pin 104, and a second contact pin 106. In an arrangement in which the outer contact member 102 is electrically conductive, the connector 100 also can include a first dielectric member 108 and a second dielectric member 110 disposed between the outer contact member 102 and respective contact pins 104, 106. The first and second dielectric members 108, 110 can serve to guide the contact pins 104, 106, as further discussed below, and to insulate the contact pins 104, 106 from the outer contact member 102. Further, the outer contact member 102 can comprise a first end portion 112 and an opposing second end portion 114 having respective annular protrusions 113, 115 for engaging respective ones of connector receptacles, as is also discussed below. Slots 116, 118 can be formed in each of the first and second end portions 112, 114 to facilitate flexure of the end portions 112, 114 when the end portions 112, 114 are inserted into respective connector receptacles.

Figure 2:
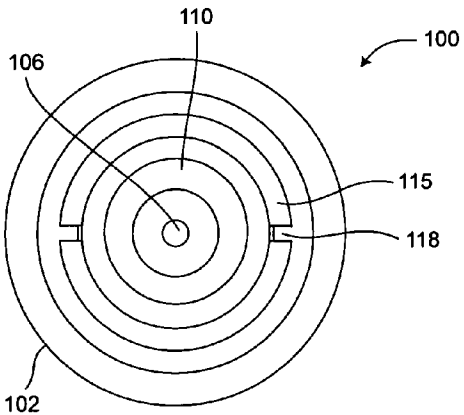
FIG. 2 is an end view of the coaxial connector of FIG. 1.

FIG. 2 is an end view of the coaxial connector 100 of FIG. 1. As shown, the second contact pin 106 and second dielectric member 110 can be coaxially aligned with the outer contact member 102. The first contact pin and first dielectric member (not shown) also can be coaxially aligned with the outer contact member 102.

Figure 3:
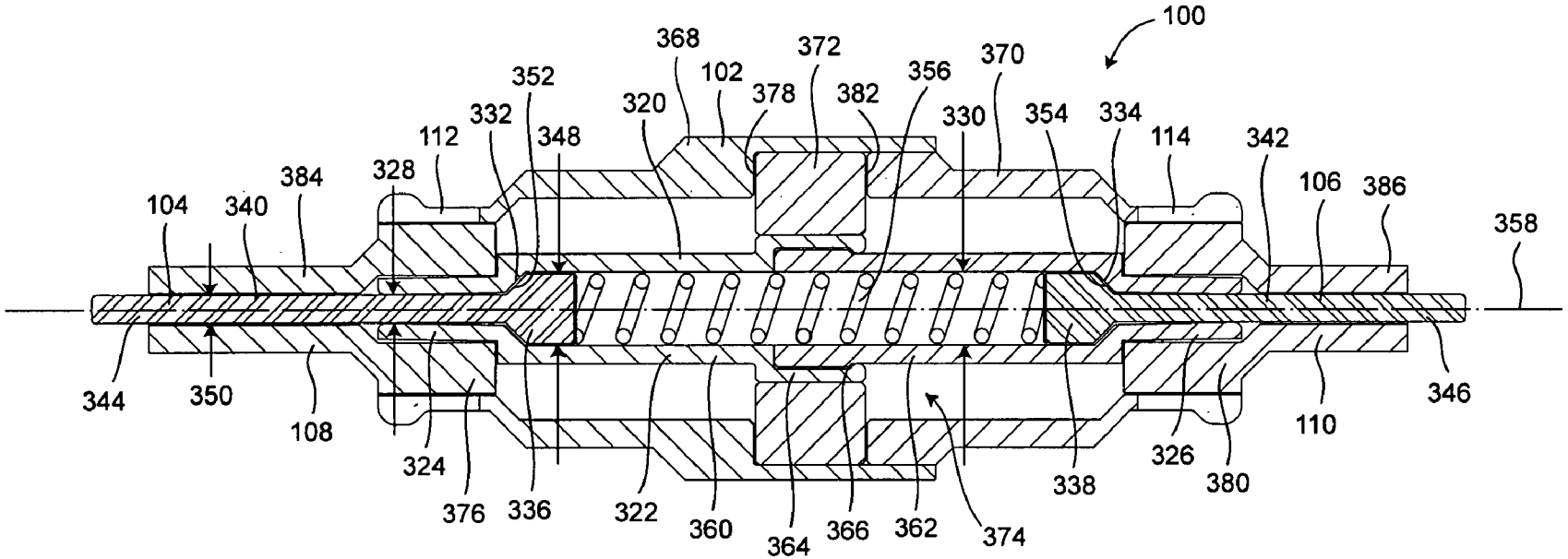
FIG. 3 is a cross-sectional view of the coaxial connector of FIG. 1, taken along line 3—3.

FIG. 3 is a cross-sectional view of the coaxial connector 100 of FIG. 1, taken along line 3—3. An inner alignment member 320 having at least one substantially tubular portion 322 can be coaxially positioned within the outer contact member 102. The inner alignment member 320 also can comprise a first end portion 324 and an opposing second end portion 326. The first and second end portions 324, 326 can have an inner diameter 328 which is smaller than an inner diameter 330 of the tubular portion 322, thereby defining transitions 332, 334 where the first and second end portions 324, 326 engage the tubular portion 322. The inner diameters 328 of the first and second end portions 324, 326 can define guide channels for the respective contact pins 104, 106.

In addition, each contact pin 104, 106 can comprise respective first end portions 336, 338, shafts 340, 342, and respective second end portions 344, 346. The first end portions 336, 338 of the contact pins 104, 106 can have an outer diameter 348 which is greater than the inner diameter 328 of the first and second end portions 324, 326 of the inner alignment member 320, but slightly smaller than the inner diameter 330 of the tubular portion 322. Further, prior to assembly of the connector 100, the shafts 340, 342 of the contact pins 104, 106 can have an outer diameter 350 which is slightly larger than the inner diameter 328 of the first and second end portions 324, 326 of the inner alignment member 320.

The inner alignment member 320 can be electrically conductive. The first and second end portions 324, 326 can be provided with slots (not shown). The slots can allow the inner diameter 328 of the first and second end portions 324, 326 to expand when the shafts 340, 342 of the contact pins 104, 106 are inserted into the respective end portions 324, 326, yet also allow for the second end portions 324, 326 to be resiliently biased against the shafts 340, 342. Such a configuration can insure suitable electrical continuity between the contact pins 104, 106 and the inner alignment member 320, and thus provide electrical continuity between the respective contact pins 104, 106. Further, the tubular portion 322 of the inner alignment member 320 can contact the first end portions 336, 338 of the contact pins 104, 106 and serve to guide the contact pins 104, 106 along the central axis 358.

Figure 4:
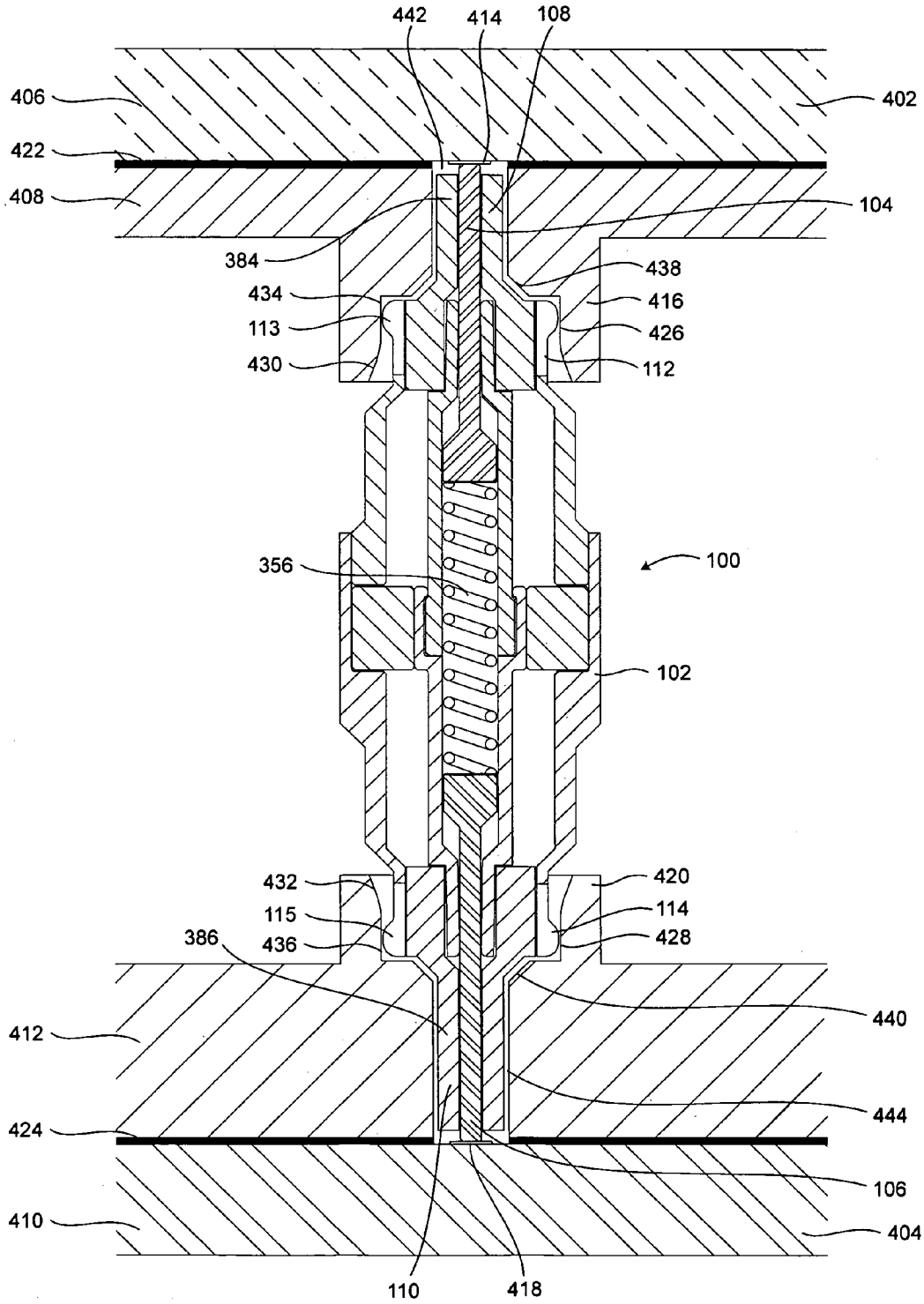
FIG. 4 is a cross-sectional view of the coaxial connector of FIG. 1 interposed between first and second printed circuit boards.

Respective transitions 352, 354 can be defined on the contact pins 104, 106 where the respective shafts 340, 342 engage the first end portions 336, 338. Further, at least one spring 356 can be disposed within the tubular portion 322 of the inner alignment member 320, between the respective first end portions 336, 338 of the contact pins 104, 106. The spring 356 can resiliently bias the contact pins to positions in which the transitions 352, 354 of the contact pins 104, 106 engage respective transitions 332, 334 of the inner alignment member 320 when the respective second end portions 344, 346 of the contact pins 104, 106 extend a suitable distance beyond respective end portions 324, 326 of the inner alignment member 320. A suitable distance is a distance which insures that the contact pins 104, 106 will contact correlating contact pads when the coaxial connector 100 is properly inserted into mating connector receptacles. The spring 356 can compress to allow inward movement of the contact pins 104, 106 along a central axis 358 of the tubular portion 322. Turning attention briefly to FIG. 4, the spring 356 provides pin extension adjustment to automatically compensate for variations in contact pad 414, 418 locations while maintaining an amount of contact pressure between the contact pins 104, 106 and respective contact pads 414, 418.

Referring again to FIG. 3, the inner alignment member 320 can comprise a first portion 360 and a second portion 362. The first portion 360 can include a clasp 364 and the second portion 362 can comprise a ridge 366. Advantageously, the inner alignment member 320 can be inexpensively assembled by first inserting the contact pins 104, 106 into the respective portions 360, 362 of the inner alignment member 320, then inserting the spring 356 into one of the portions 360, 362, and finally pressing the first and second portions 360, 362 together along the central axis 358 so that the clasp 364 engages the ridge 366. Those skilled in the art will appreciate that other suitable means can be used to join the first and second portions 360, 362 and that the invention is not limited in this regard.

Similarly, the outer contact member 102 can include a first portion 368 and a second portion 370. To assemble the connector 100, a third dielectric member 372 can be placed around the tubular portion 322 of the inner alignment member 320. Additionally, first and second dielectric members 108, 110 can be placed over the first and second end portions 324, 326 of the inner alignment member 320 and over portions of the shafts 340, 342 of the contact pins 104, 106, respectively. Together, the dielectric members 108, 110, 372, the inner alignment member 320, the contact pins 104, 106 and the spring 356 can form an inner assembly 374.

The first portion 368 of the outer contact member 102 then can be positioned over the inner assembly 374 such that a base portion 376 of the first dielectric member 108 fits within the first end portion 112 of the outer contact member 102. Further, a ridge 378 defined in the first portion 368 can abut the third dielectric member 372. Likewise, the second portion 370 of the outer contact member 102 then can be positioned over the inner assembly 374 such that a base portion 380 of the second dielectric member 110 fits within the second end portion 114 of the outer contact member 102, and a ridge 382 defined in the second portion 370 abuts against the third dielectric member 372. Further, each of the dielectric members 108, 110 can include a protruded portion 384, 386, respectively, which extends beyond respective end portions 324, 326 of the inner alignment member 320. The protruded portions 384, 386 of the dielectric members 108, 110 can cooperate with the inner alignment member 320 to guide the contact pins 104, 106 and minimize their transverse movement. Accordingly, movement of the contact pins 104, 106 can be substantially aligned with the central axis 358.

The first and second portions 368, 370 of the outer contact member 102 can be pressed together along the central axis 358 and secured in any suitable manner. For example, the first and second portions 368, 370 can be press fitted, a clasp (not shown) can fix together the first and second portions 368, 370, or the first and second portions 368, 370 can be welded, soldered or glued. Nonetheless, those skilled in the art will appreciate that any of a myriad of techniques can be used to join the first and second portions 368, 370 and the invention is not so limited.

In order to minimize signal reflections, it is generally desirable for a coaxial connector to have a characteristic impedance which matches the characteristic impedance of the circuits which are being connected by the coaxial connector. The permittivity of the dielectric members 108, 110, 372 and spacing between the inner alignment member 320 and the outer contact member 102 can be selected to achieve such a desired characteristic impedance. Selection of such parameters is known to the skilled artisan.

FIG. 4 is a cross-sectional view of the coaxial connector 100 of FIG. 1 interposed between a first PCB 402 and a second PCB 404. Each of the PCBs 402, 404 can include one or more of substrate layers 406, 410. Furthermore, each PCB 402, 404 can include additional structures attached thereto. For example, a first rigid member 408 can be attached to the PCB 402 and a second rigid member 412 can be attached to the PCB 404. The rigid members 408, 412 can provide mechanical support and/or thermal dissipation for the PCBs 402, 404. The rigid members 408, 412 can be attached to the respective PCBs 402, 404 by any suitable means. For instance, the rigid members 408, 412 can be soldered to the PCBs 402, 404, attached to the PCBs 402, 404 with an adhesive, or attached to the PCBs 402, 404 with fasteners. In one arrangement, an electrically conductive adhesive can be used to attach the rigid members 408, 412 to the PCBs 402, 404 to provide electrical conductivity between the rigid members 408, 412 and the PCBs 402, 404.

The first PCB 402 can include a first contact pad 414 on the substrate layer 406. A first receptacle 416 can be formed in the rigid member 408. Likewise, the second PCB 404 can include a second contact pad 418 on the substrate layer 410 and a second receptacle 420 can be formed in the rigid member 412. The first and second contact pads 414, 418 can be electrically connected to respective circuit traces 422, 424. As shown, the circuit traces 422, 424 can be formed on respective surfaces of the PCBs 402, 404. However, the invention is not limited in this regard. For example, in an embodiment in which the PCBs are multilayer boards formed from a plurality of stacked substrate layers, the circuit traces 422, 424 can be formed on any of the substrate layers. Manufacturing of multilayer PCBs is well known to the skilled artisan.

The rigid members 408, 412 can be formed of any suitable material, for example metal or plastic, and the first and second receptacles 416, 420 can be integrally formed in the respective rigid members 408, 412 in any suitable manner, for instance using conventional machining techniques. In an embodiment in which the rigid members 408, 412 are formed from plastic, an electrically conductive plating can be applied to inner surfaces 426, 428 of the receptacles and to the surface of the structure in electrical contact with the substrate. Notably, a plurality of receptacles can be formed in the first and second rigid members 408, 412 to accommodate a plurality of connections between the opposing PCBs 402, 404.

Each if the inner surfaces 426, 428 of the respective receptacles 416, 420 can have a contour which engages the respective first and second end portions 112, 114 of the outer contact member 102. For example, first portions 430, 432 of the respective inner surfaces 426, 428 can have a diameter that is larger than the diameter of the annular protrusions 113, 115 of the respective end portions 112, 114, and second portions 434, 436 of the inner surfaces 426, 428 can have a diameter that is slightly smaller than the diameter of the annular protrusions 113, 115. Further, third portions 438, 440 can be contoured to accommodate the first and second dielectric members 108, 110.

Holes 442, 444 can be formed through each of the rigid members 408, 412. The holes 442, 444 can be located within regions defined by the receptacles 416, 420 to expose the respective first and second contact pads 414, 418. The diameter of the holes 442, 444 can be larger than the diameter of the protruded portions 384, 386 of the dielectric members 108, 110 to facilitate insertion of the protruded portions 384, 386 into the holes 442, 444, even if the holes 442, 444 are not perfectly aligned. Accordingly, the coaxial connector 100 can be press fit into the respective receptacles 416, 420 and the contact pins 104, 106 can seat against the contact pads 414, 418, thereby providing an electrically continuous path between contact pads 414, 418 and any circuit traces connected thereto, for instance circuit traces 422, 424. The spring 356 can resiliently bias the contact pins 104, 106 in their seated positions.

Each of the inner surfaces 426, 428 of the receptacles 416, 420 can be formed from an electrically conductive material or metallized with an electrically conductive coating. The conductive material or coating can be electrically connected to one or more electrical conductors, for example ground conductors. Accordingly, the outer contact member 102 and receptacles 416, 420 can provide an electrically continuous path between circuits on the respective PCBs 402, 404. For example, the outer contact member 102 and receptacles 416, 420 can provide a signal return path, or ground, for signals transmitted between the PCBs 402, 404.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

We claim:

1. A coaxial connector comprising:

an outer contact member;

a first contact pin electrically isolated from said outer contact member and at least partially disposed within said outer contact member;

a second contact pin electrically isolated from said outer contact member and at least partially disposed within said outer contact member;

at least one spring disposed between said first and second contact pins and resiliently biasing said first contact pin in a direction away from said second contact pins.

2. The coaxial connector of claim 1, wherein said first and second pins are coaxially aligned with said outer contact member.

3. The coaxial connector of claim 1, wherein said first contact pin comprises a first end portion disposed within said outer contact member and a second end portion extending beyond said outer contact member.

4. The coaxial connector of claim 3, wherein said second contact pin comprises a first end portion disposed within said outer contact member and a second end portion extending beyond said outer contact member.

5. The coaxial connector of claim 1, further comprising at least one dielectric member disposed between said outer contact member and at least one of said first and second contact pins.

6. A coaxial connector comprising:

an outer contact member;

an inner alignment member coaxially positioned within said outer contact member, said inner alignment member comprising at least one substantially tubular portion and opposing first and second end portions;

a first contact pin having a first end portion contained within said at least one substantially tubular portion and a second end portion extending beyond said first end portion of said inner alignment member;

a second contact pin having a first end portion contained within said at least one substantially tubular portion and a second end portion extending beyond said second end portion of said inner alignment member;

at least one spring disposed between said first end portions of said first and second contact pins and resiliently biasing said first contact pin in a direction away from said second contact pin.

7. The coaxial connector of claim 6, further comprising at least one dielectric member disposed between said outer contact member and at least one of said first and second end portions of said inner alignment member.

8. The coaxial connector of claim 7, wherein said at least one dielectric member comprises a protruded portion extending beyond said at least one of said first and second end portions of said inner alignment member and defining a guide channel for a respective one of said first and second contact pins.

9. The coaxial connector of claim 6, wherein said inner alignment member is electrically conductive.

10. A coaxial connector comprising:

an outer contact member;

an electrically conductive inner alignment member coaxially positioned within said outer contact member, said inner alignment member comprising at least one substantially tubular portion and opposing first and second end portions;

a first contact pin having a first end portion contained within said at least one substantially tubular portion and a second end portion extending beyond said first end portion of said inner alignment member;

a second contact pin having a first end portion contained within said at least one substantially tubular portion and a second end portion extending beyond said second end portion of said inner alignment member;

at least one spring disposed between said first end portions of said first and second contact pins and resiliently biasing said first contact pin in a direction away from said second contact pin;

at least one dielectric member disposed between said outer contact member and at least one of said first and second end portions of said inner alignment member, said at least one dielectric member comprising a protruded portion extending beyond said at least one of said first and second end portions of said inner alignment member and defining a guide channel for a respective one of said first and second contact pins.

11. An electrical system comprising:

a first printed circuit board and a second printed circuit board, each of said first and second printed circuit boards comprising:

a connector receptacle;

a contact pad;

a coaxial connector interposed between said first and second printed circuit boards, said coaxial connector comprising:

an outer contact member;

a first contact pin electrically isolated from said outer contact member and at least partially disposed within said outer contact member;

a second contact pin electrically isolated from said outer contact member and at least partially disposed within said outer contact member;

at least one spring disposed between said first and second contact pins and resiliently biasing said first contact pin in a direction away from said second contact pin;

wherein said first contact pin contacts said contact pad of said first printed circuit board, said first end portion of said outer contact member is positioned within said connector receptacle of said first printed circuit board, said second contact pin contacts said contact pad of said second printed circuit board, and said second end portion of said outer contact member is positioned within said connector receptacle of said second printed circuit board.

12. The electrical system of claim 11, wherein said first and second contact pins are coaxially aligned with said outer contact member.

13. The electrical system of claim 11, wherein said first contact pin comprises a first end portion disposed within said outer contact member and a second end portion extending beyond said outer contact member.

14. The electrical system of claim 13, wherein said second contact pin comprises a first end portion disposed within said outer contact member and a second end portion extending beyond said outer contact member.

15. The electrical system of claim 11, said coaxial connector further comprising at least one dielectric member disposed between said outer contact member and at least one of said first and second contact pins.

16. An electrical system comprising:

a first printed circuit board and a second printed circuit board, each of said first and second printed circuit boards comprising:

a connector receptacle;

a contact pad;

a coaxial connector interposed between said first and second printed circuit boards, said coaxial connector comprising:

an outer contact member having opposing first and second end portions;

an inner alignment member coaxially positioned within said outer contact member, said inner alignment member comprising at least one substantially tubular portion and opposing first and second end portions;

a first contact pin having a first end portion contained within said at least one substantially tubular portion and a second end portion extending beyond said first end portion of said inner alignment member;

a second contact pin having a first end portion contained within said at least one substantially tubular portion and a second end portion extending beyond said second end portion of said inner alignment member;

at least one spring disposed between said first end portions of said first and second contact pins and resiliently biasing said first contact pin in a direction away from said second contact pin;

wherein said first contact pin contacts said contact pad of said first printed circuit board, said first end portion of said outer contact member is positioned within said connector receptacle of said first printed circuit board, said second contact pin contacts said contact pad of said second printed circuit board, and said second end portion of said outer contact member is positioned within said connector receptacle of said second printed circuit board.

17. The electrical system of claim 16, said coaxial connector further comprising at least one dielectric member disposed between said outer contact member and at least one of said first and second end portions of said inner alignment member.

18. The electrical system of claim 17, wherein said at least one dielectric member comprises a protruded portion extending beyond said at least one of said first and second end portions of said inner alignment member and defining a guide channel for a respective one of said first and second contact pins.

19. The electrical system of claim 16, wherein said inner alignment member is electrically conductive.

* * * * *